US010892131B2

(12) United States Patent
Andaluz Sorlí

(10) Patent No.: US 10,892,131 B2
(45) Date of Patent: Jan. 12, 2021

(54) FUSE SWITCH MODULE

(71) Applicant: Gorlan Team, S. L. U, Amorebieta (ES)

(72) Inventor: Jose Oscar Andaluz Sorlí, Saragossa (ES)

(73) Assignee: GORLAN TEAM, S.L.U, Amorebieta (ES)

( * ) Notice: Subject to any disclaimer, the term of this patent is extended or adjusted under 35 U.S.C. 154(b) by 0 days.

(21) Appl. No.: 16/530,834

(22) Filed: Aug. 2, 2019

(65) Prior Publication Data

US 2020/0051770 A1 Feb. 13, 2020

(30) Foreign Application Priority Data

Aug. 7, 2018 (EP) ..... 18382599

(51) Int. Cl.

*H01H 89/00* (2006.01)
*H01H 85/20* (2006.01)
*H01H 85/22* (2006.01)
*H01H 85/60* (2006.01)

(52) U.S. Cl.

CPC ..... *H01H 89/00* (2013.01); *H01H 85/205* (2013.01); *H01H 85/22* (2013.01); *H01H 85/60* (2013.01)

(58) Field of Classification Search

CPC ..... H01H 89/00; H01H 85/205; H01H 85/22; H01H 85/60; H01H 85/25; H01H 9/102; H01H 1/2041; H01H 85/545

USPC ..... 337/10, 186, 208, 209, 211, 245, 259, 337/284

See application file for complete search history.

(56) References Cited

U.S. PATENT DOCUMENTS 3,406,365 A 10/1968 Lameyre
4,559,504 A * 12/1985 Krec ..... H01H 85/26 337/194
5,076,118 A * 12/1991 Lawson ..... B25B 9/00 81/3.8
5,616,054 A * 4/1997 Quinlan ..... H01H 85/545 439/620.26

(Continued)

FOREIGN PATENT DOCUMENTS

DE 1 788 050 A1 1/1972
GB 188820 A 11/1922

(Continued)

*Primary Examiner* — Stephen S Sul
(74) *Attorney, Agent, or Firm* — Seed Intellectual Property Law Group LLP

(57) ABSTRACT

The invention refers to a low-cost fuse switch module that comprises a pair of fixed contacts and a rotary contact rotatable about a rotation axis located in-between the fixed contacts. The rotary contact is rotatable between a closed position in which it is connected with the fixed contacts to enable current circulation, and an open position in which the rotary contact is electrically isolated from the pair of fixed contacts. An overcurrent protection fuse is provided for limiting maximum current circulation through the contacts in the closed position, and the fuse is rotatable about the axis and it is arranged to operate as the rotary contact of the switch, such as by rotating the fuse about the rotation axis, the switch reciprocally transit from the closed to the open position.

10 Claims, 7 Drawing Sheets

(56) References Cited

U.S. PATENT DOCUMENTS 5,969,587 A * 10/1999 Combas ..... H01H 85/545 335/132
6,727,797 B1 * 4/2004 Bruchmann ..... H01H 9/104 337/194
6,759,939 B2 * 7/2004 Sudan ..... H01H 11/0031 337/208
6,794,979 B2 * 9/2004 Sudan ..... H01H 85/0091 337/208
7,355,503 B2 * 4/2008 Buettner ..... H01H 85/545 337/208
8,310,333 B2 * 11/2012 Ventura ..... H01H 85/545 337/187
8,614,618 B2 * 12/2013 Darr ..... H01H 9/10 337/72
9,136,083 B2 * 9/2015 Brakefield ..... H01R 13/648
9,384,930 B2 * 7/2016 Lu ..... H01H 85/545
2005/0285710 A1 * 12/2005 Buettner ..... H01H 85/545 337/231
2008/0048819 A1 * 2/2008 Darr ..... H01H 85/30 337/206
2013/0015940 A1 1/2013 Dunker
2013/0133716 A1 * 5/2013 Buettner ..... H01L 31/05 136/244
2013/0187747 A1 * 7/2013 Reibke ..... H01H 85/202 337/213
2014/0009255 A1 * 1/2014 Lu ..... H01H 85/60 337/180
2017/0365436 A1 * 12/2017 Brakefield ..... H01H 85/25

FOREIGN PATENT DOCUMENTS

GB 332414 A 7/1930
WO 01/08180 A1 2/2001
WO 2009/037022 A1 3/2009

* cited by examiner

FUSE SWITCH MODULE

OBJECT OF THE INVENTION

The present invention refers in general to the construction of switches incorporating overcurrent protection fuses.

An object of the invention is to provide a low cost fuse switch, that can be constructed with a low number of components, and that features a compact design.

Another object of the invention is to provide a more efficient fuse switch, that causes very small power losses during stationary state of the switch.

BACKGROUND OF THE INVENTION

Fuses are widely used in electrical circuits to protect electrical or electronic components from electrical over-currents, so that when electrical current through a fuse exceeds a predetermined limit, the fuse melts and current circulation through the fuse is interrupted and components damage is thereby prevented.

It is also known to use fuses, not only as a protection element against over-currents, but also for switching purposes by connecting or disconnecting a fuse form a circuit, so that, an electrical circuit is closed or interrupted through the fuse.

For example, the U.S. Patent application US 2013/015940 is an example of a switch incorporating a fuse, wherein the fuse is housed in a fuse holder having terminals that are electrically coupled to a circuitry. When conductive portions of the fuse, such as fuse blades are engaged to the fuse holder terminals, an electrical circuit is formed through the fuse, and when conductive portions of the fuse are disengaged from the fuse holder terminals, the electrical circuit through the fuse is broken. Therefore, by inserting and removing the fuse to and from the fuse holder terminals, a fused disconnect switch is realized.

Typically, in this fuse switches, the fuse has always been conceived as a static component during the stationary state of the switch, with the only purpose of protecting against over-currents, that is, the fuse has been always been conceived as an complementary component to the switch itself. For the connection of the fuse in the switch, it is necessary to provide ancillary components, like a fuse holder, blades and electric connections with the switch contacts, so that manufacturing cost, complexity and size of these switches, are increased by the provision of these ancillary components.

Additionally, each electric connection between those ancillary components are "hot spots", that causes power losses, thus, the larger the number of interconnections, the larger the power losses.

On the other hand, fuse holder bases are known devices used for engaging or disengaging electric fuses in electric installations. These fuse holder bases generally comprises a base attachable to the busbars of an installation, and a cover pivotally attached to the base and incorporating a fuse, such as the fuse is angularly movable with respect to the base. The fuse holder can have two positions: an operative or engaged position, in which connection is established; and a disengaged position, in which the cover and the fuse are tilted with respect to the base, therefore disengaged.

The PCT patent application WO 2009/037022 is an example of these fuse holder bases. It can be noted for example in FIG. 1 of this PCT publication, that the pivot axis (8) is located at one end of the fuse base.

Even if fuse holders bases actually operate as switches, their main purpose is simply to provide access to the fuse for replacement or maintenance task, but generally these are not used as main switches of an electric installation.

It is desirable in this technical field, to provide low-cost switches, with reduced power losses and more sustainable.

SUMMARY OF THE INVENTION

The present invention is defined in the attached independent claim, and it refers to a fuse switch module in which the fuse has a double function, as a fuse and at the same time as an integral part of the switch mechanism, to operate as moving contact of the switch for the transition between the open and closed positions of the switch, by interconnecting and disconnecting a pair of fixed contact of the switch.

Therefore, and aspect of the invention refers to a fuse switch module comprising: a pair of fixed contacts and a rotary contact rotatable about a rotation axis located at a space in-between the fixed contacts. The rotary contact is rotatable between a closed position in which it is connected with the fixed contacts to enable current circulation, and an open position in which the rotary contact is electrically isolated from the pair of fixed contact to prevent current circulation.

The fuse switch module additionally comprises an over-current protection fuse for limiting maximum current circulation through the fixed and rotary contacts, in the closed position of the switch.

According to the invention, the fuse is rotatable about the rotation axis (X) and the fuse is arranged to operate as the rotary contact, such as by rotating the fuse about the rotation axis (X), the switch reciprocally transit from the closed to the open position (and vice-versa).

Conventionally, the fuse has elongated body and two connection terminals at opposite ends of the fuse body. According to the invention the rotation axis (X) runs transversally across the fuse body in-between the two connection terminals, so that the two terminals move on the same plane when the fuse is rotated above the axis (X).

The switch is configured such the fuse can rotate about the rotation axis (X) an angle ($\alpha$) between the closed and open positions, and wherein the angle ($\alpha$) is within the range (45°-90°), and preferably the angle (a) is 90°.

The fuse switch comprises an electrically insulating casing, such as the fuse and the fixed contacts are enclosed within the housing during the open and closed positions of the switch, thus, the fuse cannot be extracted out of the casing during the normal use of the switch.

The casing has an aperture and the switch further comprises a cover mounted on the casing covering the aperture. The cover is movable to provide access to the casing interior through the aperture, so that the switch is configured for allowing the fuse to be extracted out of the casing through the aperture in the open position of the switch.

BRIEF DESCRIPTION OF THE DRAWINGS

Preferred embodiments of the invention are henceforth described with reference to the accompanying drawings, wherein.

PREFERRED EMBODIMENT OF THE INVENTION

Figure 1:
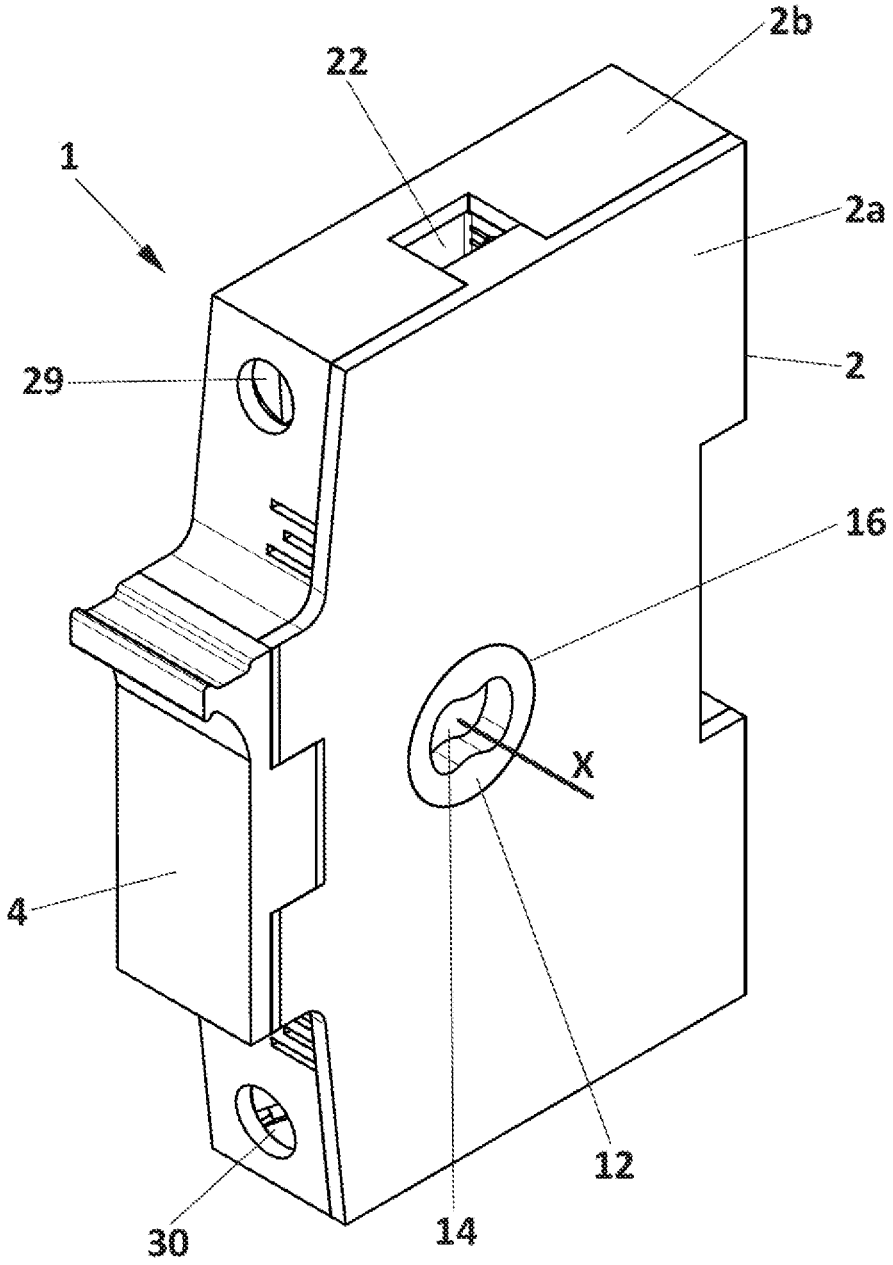
FIG. 1.—shows a perspective view of a preferred embodiment of a switch module according to the invention.
Figure 2:
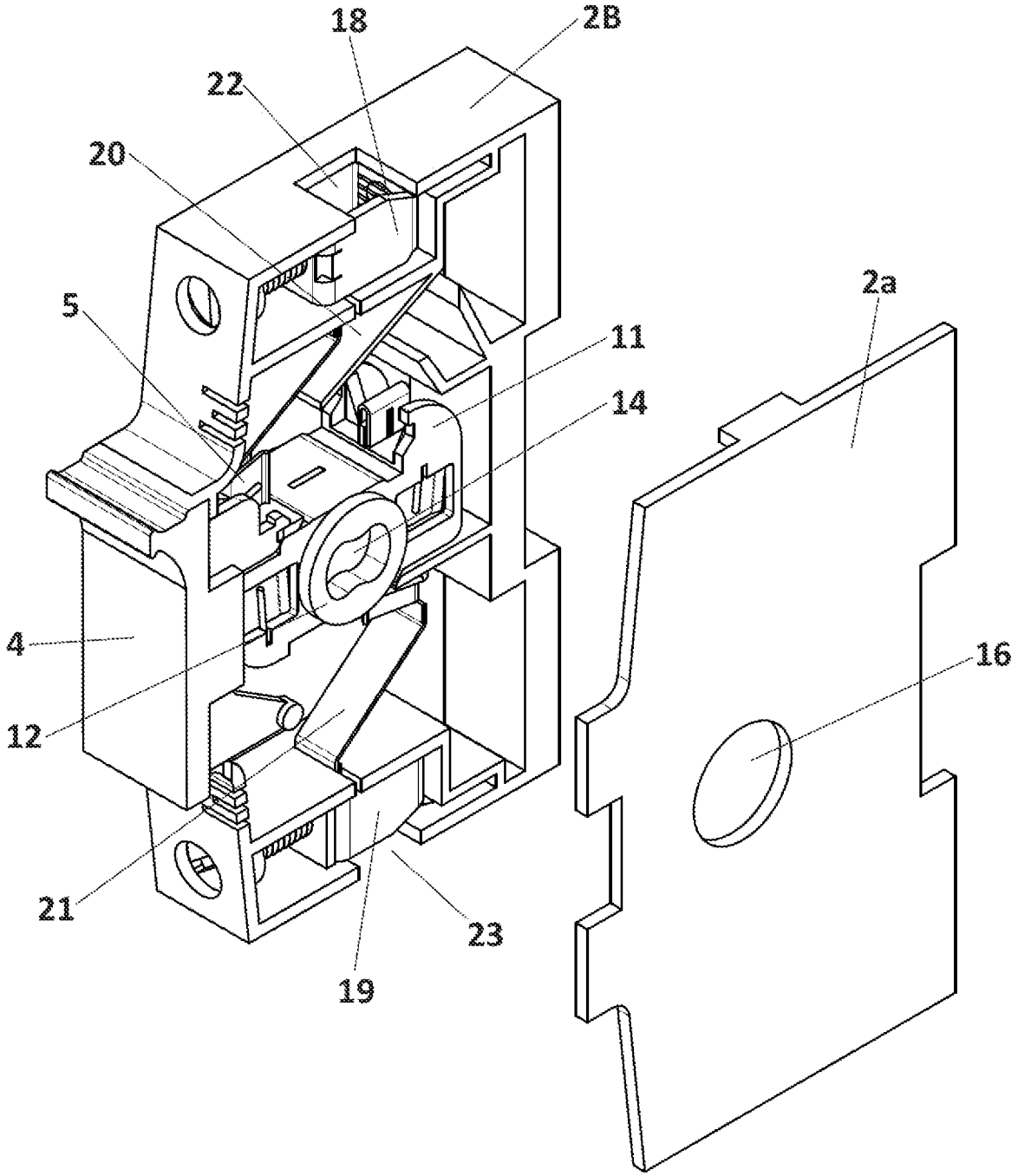
FIG. 2.—shows another perspective view with one of the casing walls represented in exploded view.

FIG. 1 shows a preferred embodiment of a fuse switch module (1) according to the invention, comprising an electrically insulating casing (2) formed by two coupled parts (2*a*,2*b*) that form together an enclose within which fixed contacts (5,6) and a fuse (8) of the switch are housed during the normal use of the switch. The casing (2) has an aperture (3) in a front wall of the casing, and a cover (4) covering the aperture (3). The cover (4) is pivotally mounted on the casing (2) so when the cover (4) is open (as shown in FIG. 7), the casing interior is accessible through the aperture (3) for extracting the fuse (8) out of the casing.

Figure 5:
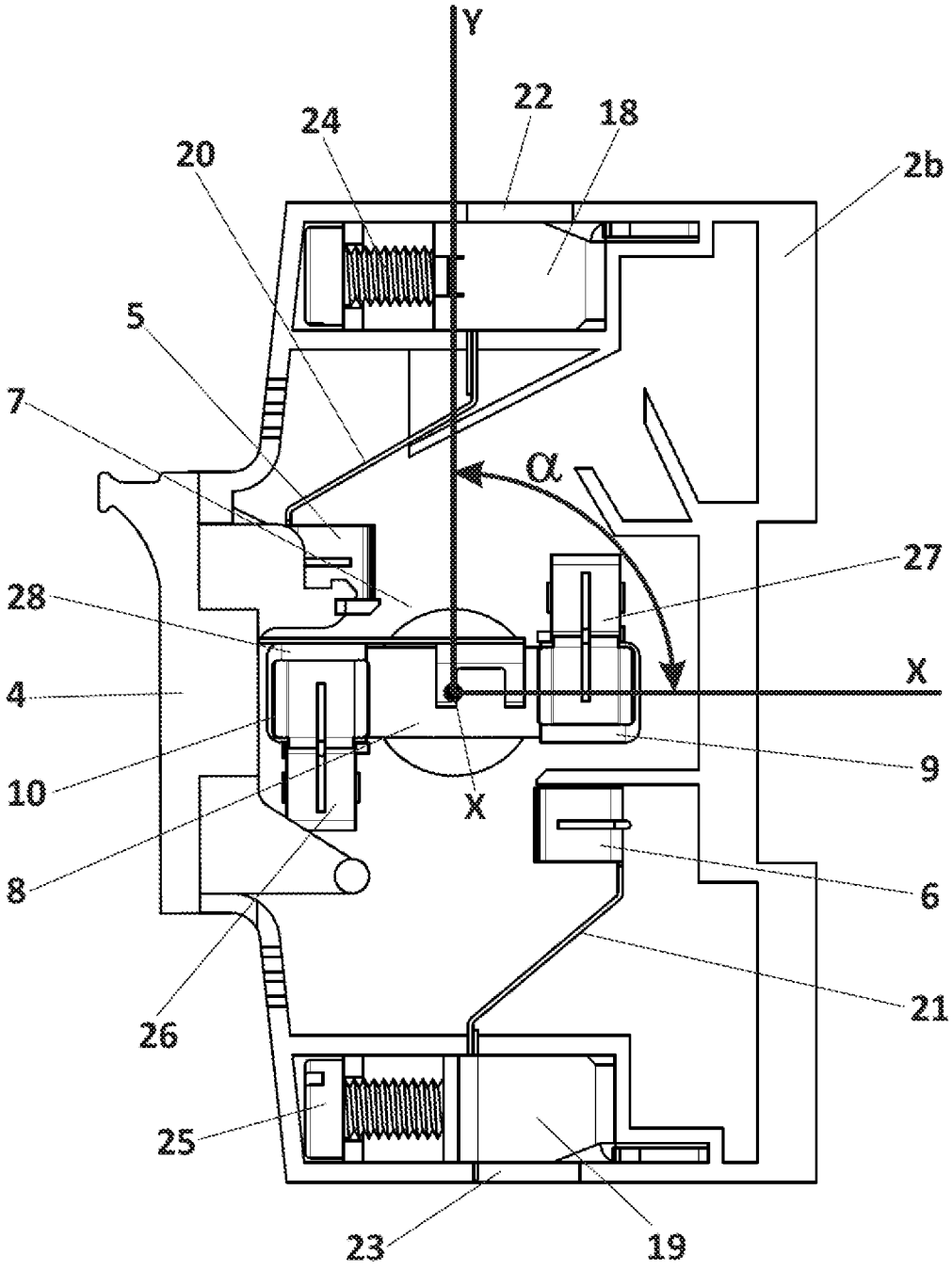
FIG. 5.—shows a side elevational view in the open position of the switch, and with the fuse cartridge removed for the sake of the illustration.
Figure 6:
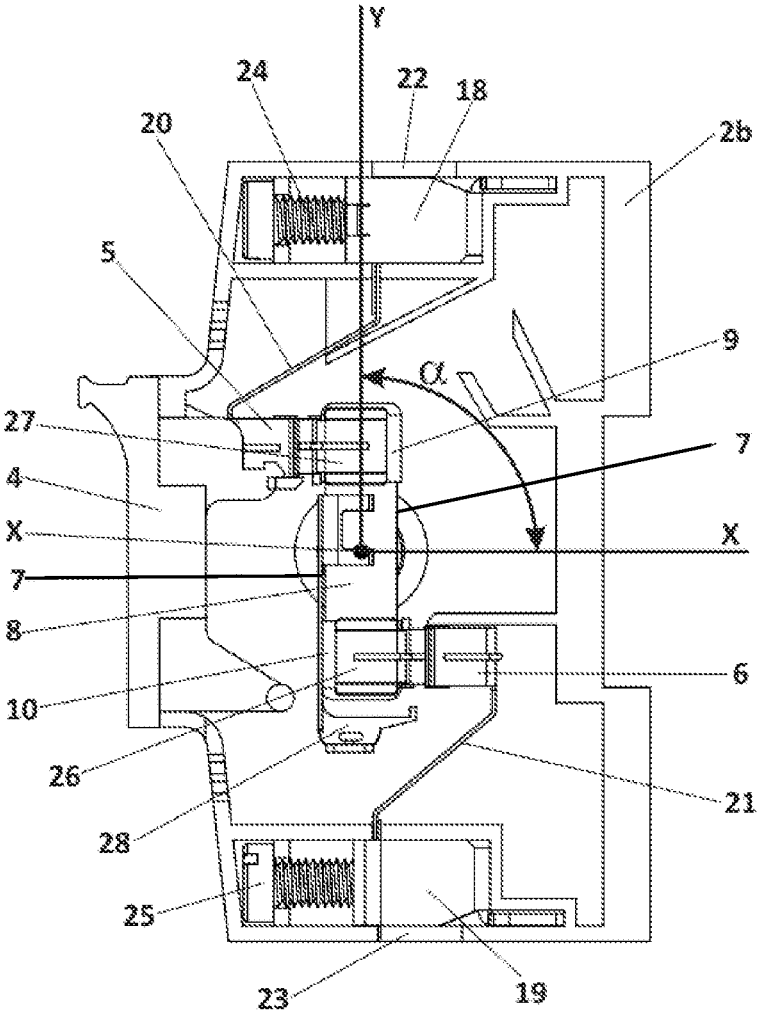
FIG. 6.—shows a similar representation than FIG. 5 but in the closed position of the switch.
Figure 7:
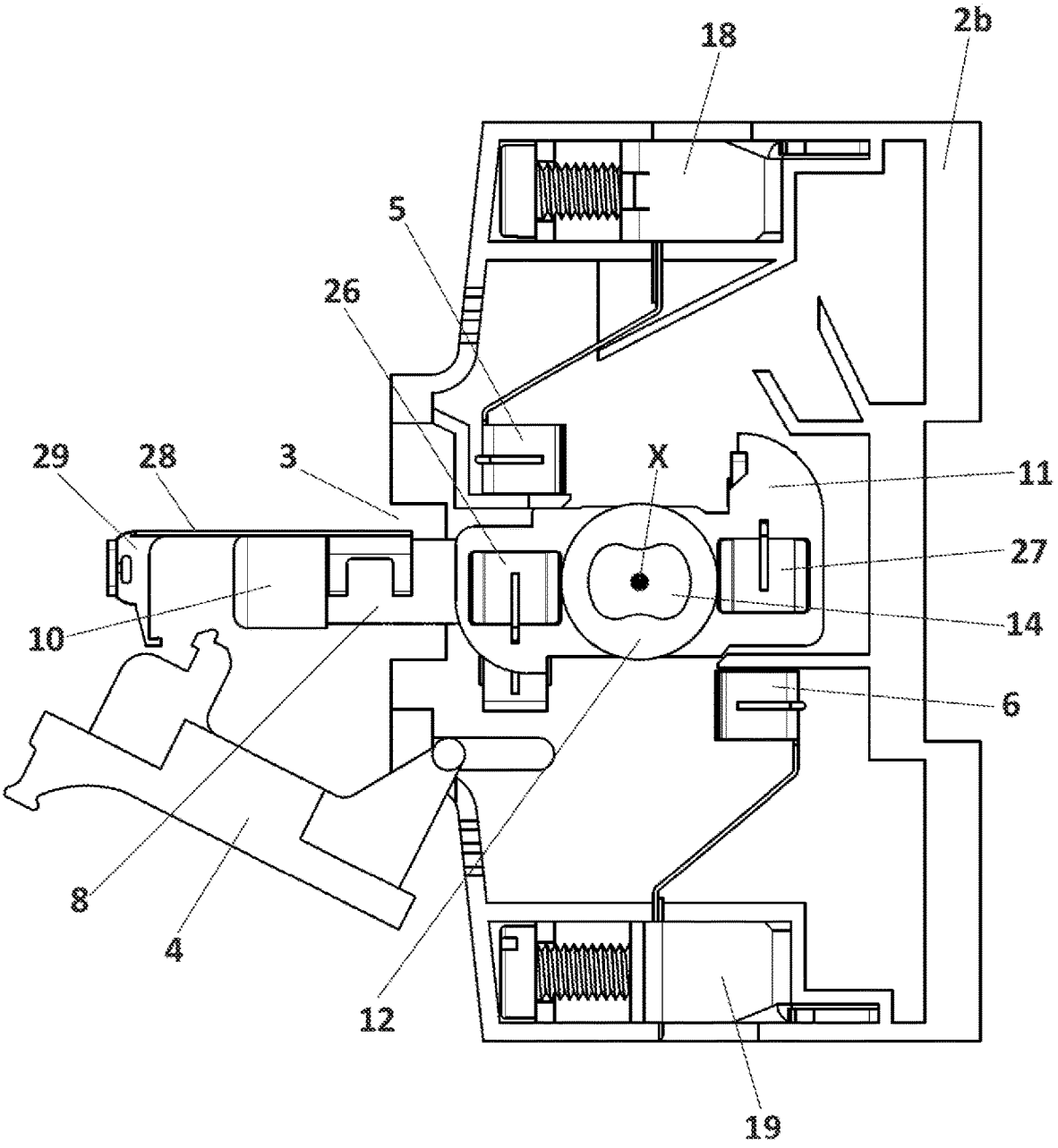
FIG. 7.—shows another side elevational view with the fuse partially extracted out of the casing.

The switch module (1) further comprises a pair of fixed contacts (5,6) in the form of tweezers, and a rotary contact (7) rotatable about a rotation axis (X) located in-between the fixed contacts (5,6), as shown more clearly in FIGS. 5-7. The switch module (1) has an overcurrent protection fuse (8) that is part of the rotary contact (7), so that the fuse (8) is rotatable about the axis (X) between a closed position (FIG. 6) in which it is connected with the fixed contacts (5,6) to enable current circulation, and an open position (FIG. 5) in which the fuse (8) is electrically isolated from the pair of fixed contact (5,6) to prevent current circulation.

Therefore, the fuse (8) operates as the rotary contact (7), so by rotating the fuse (8) about the rotation axis (X), the switch transit from the closed to the open position and vice-versa.

The fuse (8) is an elongated body and has two connection terminals (9,10) at opposite ends of the fuse. The rotation axis (X) runs transversally across the fuse (8) (transversal to the longitudinal direction of the fuse), and it is located in-between the two connection terminals (9,10), so that, the fuse is rotatable on a plane. The switch is configured such the fuse (8) rotates about the rotation axis (X) an angle ($\alpha$) between the open position (FIG. 5) and closed position (FIG. 6). The angle ($\alpha$) is within the range (45°-90°), and preferably the angle ($\alpha$) is 90° as represented in the figures.

The switch module (1) has a fuse cartridge (11) made of an electrically insulating material, such as the fuse (8) is fitted inside the cartridge (11) during the normal use of the switch, so both components cartridge (11) and fuse (8) can rotate together about the axis (XS). For that, the fuse cartridge (11) has two lateral protrusions (12,13) with circular configuration and having respective bores (14,15) for receiving an actuation shaft (not shown) for rotating the fuse cartridge (11) to operate the switch. These circular protrusions (12,13) are received respectively within circular windows (16,17) formed in the lateral walls of the casing (2), so that the rotation of the cartridge (11) is guided by the windows (16,17).

Figure 3:
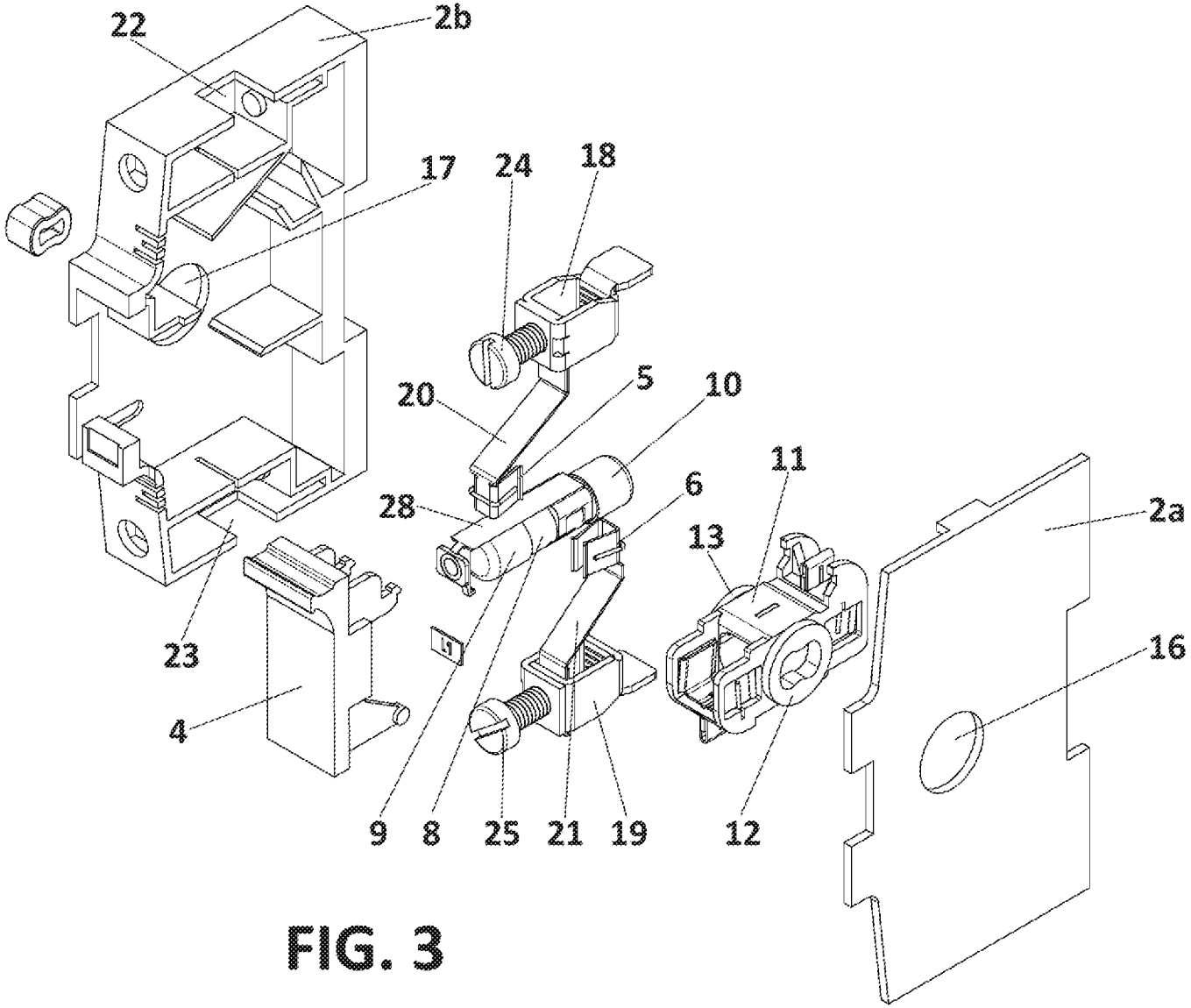
FIG. 3.—shows another exploded view of the switch module.

The switch module (1) further comprises a pair of switch terminals (18,19) enclosed within the casing (2) respectively connected with the fixed contacts (5,6) by means of connections (20,21) as shown more clearly in FIG. 3. These terminals (18,19) are accessible through upper and lower windows (22,23) provided at the casing, for their connection with an external electric circuit (not-shown), for example for their connection with wires that can be secured by means of screws (24,25) in known manner accessible through openings (29,20).

Figure 4:
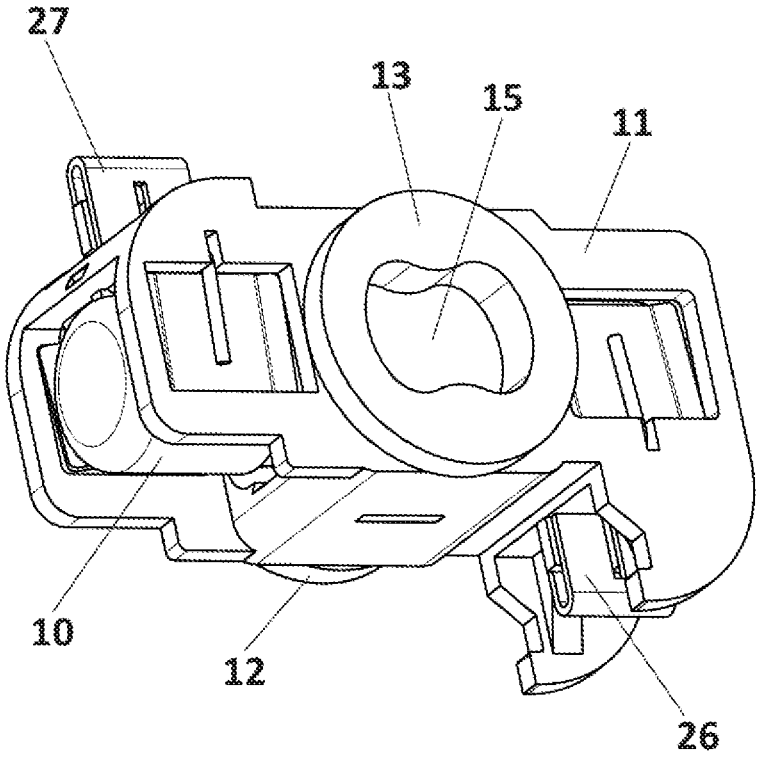
FIG. 4.—shows a perspective view of the fuse cartridge and the fuse coupled together.

The fuse cartridge (11) is represented in FIG. 4 in more detail, and it is configured to receive the fuse (8) such as, in use, the two connection terminals (9,10) can be connected with the fixed contacts (5,6) by means of a pair of blades (26,27) detachably coupled respectively with fuse terminals (9,10). The blades (26,27) protrude outside the fuse cartridge (11), and are configured for contacting with the fixed contacts (5,6) in the closed position of the switch module.

Each blade (26,27) has generally an "Y" shape in a cross-sectional view of the same, and it is configured such as its double-walled part embraces one of the fuse contacts (9,10) by elastic deformation as shown in FIG. 4, and the single-wall part of the blade can be inserted into one of the fixed contacts (5,6) as shown in FIG. 6.

A fuse carrier (28) is provided for extracting the fuse (8) out of the casing (2) for its replacement or for inspection purposes. The fuse carrier (28) is coupled with the fuse (8), and it is configured to pull the fuse (8) axially out of the casing (2) as shown in FIG. 7, by pulling one end (29) of the fuse carrier (28), either by hand or with the aid of a proper tool.

A switch can be formed in a known manner by stacking axially several switch modules (1) as the one described above, together with an actuation mechanism (not shown) having a shaft coupled axially with respect the axis (X) and with the with fuse cartridge (11).

Other preferred embodiments of the present invention are described in the appended dependent claims and the multiple combinations of those claims.

The invention claimed is:

1. A fuse switch module comprising:

a pair of fixed contacts and a fuse operable as rotary contact, wherein the fuse is rotatable about a rotation axis that extends through a point located between the fixed contacts, wherein the fuse is rotatable between a closed position, in which the rotary contact fuse is electrically connected to both of the fixed contacts to enable current circulation between the fixed contacts, and an open position, in which the rotary contact fuse is electrically isolated from the pair of fixed contacts to prevent current circulation between the fixed contacts;

wherein the fuse has two connection terminals at opposite ends thereof, and wherein the rotation axis extends transversally across the fuse through a point located between the two connection terminals;

wherein the fuse switch module further comprises two conductive blades detachably fitted respectively to the two connection terminals of the fuse and wherein the two conductive blades are configured to contact the fixed contacts when the fuse is in the closed position, and wherein each blade of the two conductive blades includes a generally Y-shaped portion such that each blade of the two conductive blades has a double-walled part that engages respectively with one of the fixed contacts by elastic deformation of the double-walled part, and wherein each blade of the two conductive blades has a single-walled part that can be inserted into one of the fixed contacts;

the fuse switch module further comprising a fuse cartridge made of an electrically insulating material, wherein the fuse is attached to the fuse cartridge such that the fuse and the fuse cartridge can rotate together, and wherein at least one of the two conductive blades protrudes outside the fuse cartridge.

2. The fuse switch module according to claim 1, further comprising an electrically insulating casing, and wherein the fuse switch module is configured such that the fuse is enclosed within the casing in both the open position and the closed position.

3. The fuse switch module according to claim 2, further comprising a pair of switch terminals accessible from outside the casing for connection of the fuse switch module to an external circuit, and wherein the pair of fixed contacts are enclosed within the casing and the switch terminals are respectively connected to the pair of fixed contacts.

4. The fuse switch module according to claim 2, wherein the electrically insulating casing has an aperture and the fuse switch module further comprises a cover mounted on the electrically insulating casing for covering the aperture, and wherein the cover is movable to provide access to a casing interior through the aperture, and wherein the fuse switch module is configured such that the fuse can be extracted out of the electrically insulating casing through the aperture when the fuse is in the open position.

5. The fuse switch module according to claim 4, further comprising a fuse carrier coupled with the fuse, wherein the fuse carrier has an end configured to be gripped and configured to pull the fuse axially out of the casing.

6. The fuse switch module according to claim 4, wherein the fuse has a cylindrical body, and in the closed position, the fuse is parallel to the aperture of the casing, and when the fuse is in the open position, the fuse is orthogonal to the aperture.

7. The fuse switch module according to claim 4, wherein the cover is pivotally mounted to the casing.

8. The fuse switch module according to claim 1, wherein the fuse can rotate about the rotation axis by an angle within the range 45°-90° from the closed position to the open position.

9. The fuse switch module according to claim 8, wherein the angle is 90°.

10. The fuse switch module according to claim 9, wherein the fuse cartridge has at least one protrusion having a bore for receiving an actuation shaft for operating the fuse switch module, wherein the protrusion is received within a circular aperture of a wall of a casing, and wherein the fuse cartridge is accessible from outside the casing, such that rotation of the fuse cartridge is guided by the aperture.

* * * * *